United States Patent [19]

Jong

[11] Patent Number: 4,765,113

[45] Date of Patent: Aug. 23, 1988

[54] ROOFING STRUCTURE

[76] Inventor: Slosson B. Jong, 20722 Hunter La., Huntington Beach, Calif. 92646

[21] Appl. No.: 24,166

[22] Filed: Mar. 10, 1987

[51] Int. Cl.[4] ..... E04D 1/30; E04D 3/366

[52] U.S. Cl. ..... 52/533; 52/541; 52/550

[58] Field of Search ..... 52/518–522, 52/550–560, 600, 601, 541–545, 533, 125.5

[56] References Cited

U.S. PATENT DOCUMENTS

| | | | |
|---|---|---|---|
| 816,252 | 3/1906 | Price | 52/533 |
| 848,537 | 3/1907 | Davis | 52/552 |
| 881,522 | 3/1908 | Winslow | 52/552 |
| 912,057 | 2/1909 | Auger | 52/518 |
| 1,086,821 | 2/1914 | Harter | 52/601 |
| 1,093,761 | 4/1914 | Blake | 52/552 |
| 1,150,425 | 8/1915 | Gore | 52/550 |
| 1,425,564 | 8/1922 | Whiteside | 52/560 |
| 2,127,199 | 8/1938 | Austhoff | 52/541 |
| 2,142,305 | 1/1939 | Davis | 52/601 |
| 2,644,410 | 7/1953 | Weber | 52/542 |
| 3,248,836 | 5/1966 | Monk et al. | 52/125.5 |
| 4,262,466 | 4/1981 | Roe | 52/550 |

FOREIGN PATENT DOCUMENTS

| | | | |
|---|---|---|---|
| 1171513 | 10/1958 | France | 52/125.4 |

*Primary Examiner*—James L. Ridgill, Jr.
*Attorney, Agent, or Firm*—William P. Green

[57] ABSTRACT

A roofing structure including tiles preferably molded of a lightweight fire resistant cement product and having grooves at their underside adapted to receive upwardly projecting flanges of coacting elements attached to a roof support structure, to locate the tiles, and with those elements desirably being shaped to extend between two adjacent tiles at a location to intercept rain falling between the tiles and direct that rain downwardly toward lower ends of the tiles. The molded bodies of the tiles contain short tubes embedded in those bodies and defining passages within the tube through which nails can be driven to secure the tiles in place. The tubes are preferably located during production of the tiles by welding the tubes to reinforcing material contained within the tile bodies, with that reinforcing material desirably including a sheet of expanded metal mesh and two channel shaped elements of expanded metal secured to the main sheet of such material and extending about the previously mentioned locating grooves at the underside of the tiles.

20 Claims, 2 Drawing Sheets

ROOFING STRUCTURE

BACKGROUND OF THE INVENTION

This invention relates to improved roofing structures and methods. Various types of molded roofing tiles or shingles have been proposed in the past, formed of numerous different materials intended to attain improved structural characteristics in a roof. For example, U.S. Pat. No. 848,537 issued Mar. 26, 1907 to C. C. Davis on "Reinforced Tile Or Slab" shows a roofing tile formed of concrete containing corrugated expanded metal mesh embedded within the concrete and reinforcing it. The tiles of this patent are secured in place by lugs projecting downwardly from the tiles and adapted to be secured by bolts to angle irons attached to the roof support structure. U.S. Pat. No. 2,142,305 issued Jan. 3, 1939 to C. F. Davis on "Building Unit And Construction" shows a number of different types of building slabs or units molded of cementitious material and having metal edge members and/or internal reinforcing sheets. Others types of shingles or tiles are shown in U.S. Pat. Nos. 912,057, 2,644,410, 881,522, 1,093,761, 4,262,466 and 1,150,425.

SUMMARY OF THE INVENTION

An object of the present invention is to provide an improved molded roofing tile which can be formed of a relatively light material but is reinforced in a manner preventing breakage in use and assuring long life characteristics to a roof formed of such tiles. The tiles are desirably fire resistant and also resistant to deterioration by moisture, infestation, or other adverse conditions normally encountered by roofs continually exposed to the elements.

Certain particular features of the invention relate to unique structural arrangements designed to facilitate positioning and attachment of a series of the tiles in a proper pattern on a roof support structure, in a manner reducing the amount of time required for roofing a building, and also preventing any possibility of leakage between adjacent tiles in the completed roof.

Proper attachment of the tiles to a roof in leak preventing relation is attained by providing in conjunction with the tiles a number of mounting and protective elements which are adapted to extend between adjacent side edges of two adjacent tiles at a location to catch or intercept rain water which may fall between those edges, and direct that water downwardly at an inclination to lower ends of the tiles in a manner preventing leakage of any of that water through these protective elements and to the underlying rafters and other roof support structure. Each of these elements may take the form of a channel shaped part formed of sheet metal or the like and having a bottom wall extending between adjacent edges of two of the tiles and projecting beneath at least one of the tiles and carrying a flange projecting upwardly into a groove formed in the underside of that tile in a relation forming a guide trough within which moisture is trapped and by which it is directed downwardly to the appropriate discharge location at lower ends of the tiles. In one form of the invention, each of these protective elements has two flanges extending along opposite edges thereof and projecting upwardly into grooves formed in two adjacent tiles in water confining relation. In another form of the invention, each protective element is permanently attached to and has portions embedded within one of the adjacent tiles, and then projects from that tile beneath a next successive tile to carry a flange projecting upwardly into a groove therein.

In order to enable a tile embodying the invention to be secured to a roof support structure by a simple nailing operation without danger of splitting the tile or damaging a protective glaze or other coating applied to its upper surface, a feature of the invention relates to the provision of short nail receiving tubes embedded within the molded material of the tile body and extending downwardly therein, to provide a preformed passage within each of these tubes through which a nail can be driven downwardly into a rafter or other support structure without damage to the material of the molded body. These tubes are preferably held in place during molding and curing of the concrete or other material of which the tile body is formed, and during use of the tile, by preattaching the tubes to reinforcing material which is also to be contained within the molded substance. Desirably the reinforcing material takes the form of a sheet of expanded metal to which the tubes may be welded. In addition to the principal sheet of reinforcing material, there may also be provided two channels of such reinforcing material welded or otherwise secured to the underside of the sheet and having flanges extending downwardly, preferably at opposite sides of the previously mentioned grooves, to effectively strenghten the tile body at the critical groove locations.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
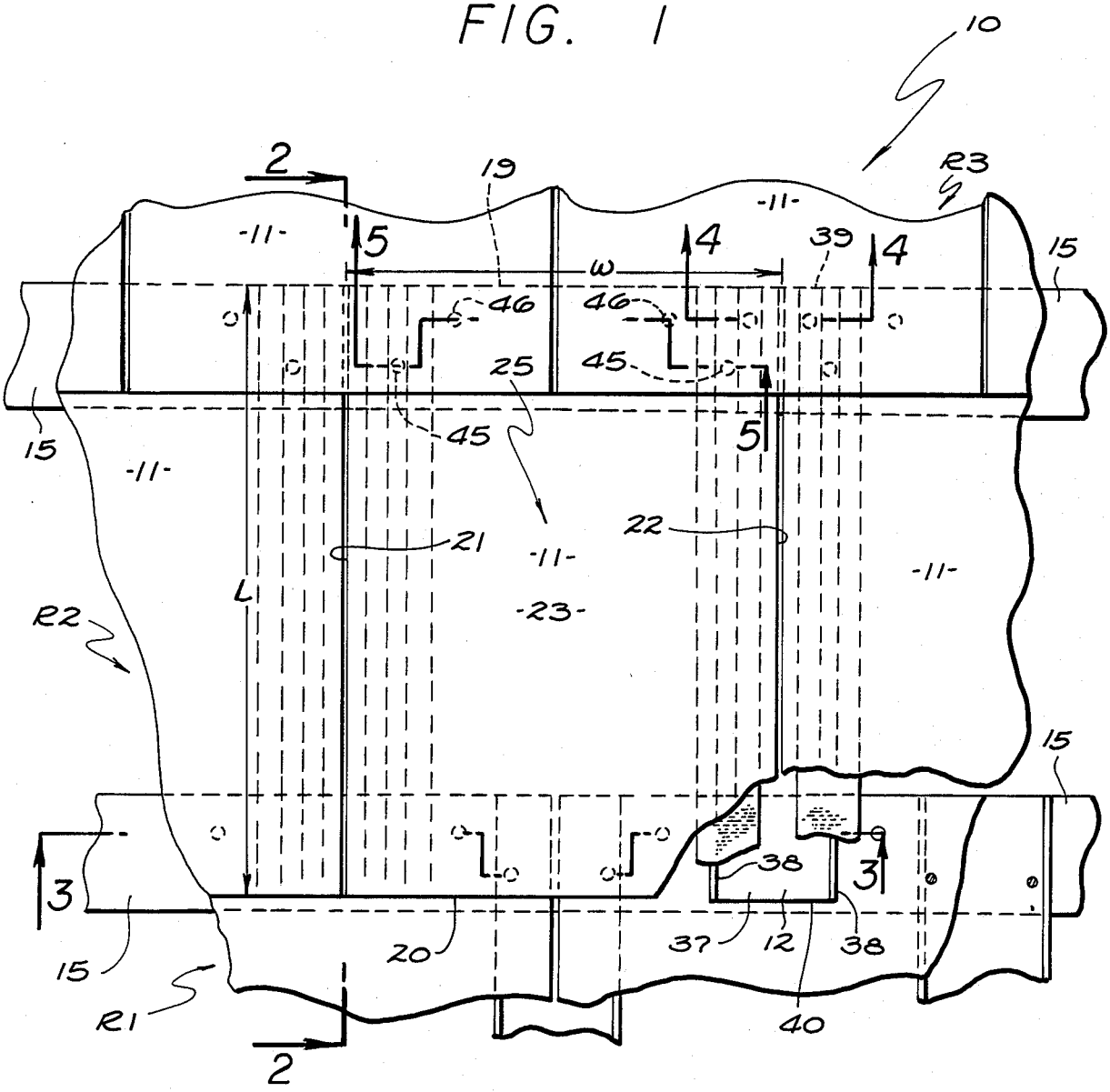
FIG. 1 is a fragmentary top elevational view of a roof formed in accordance with the invention, with this view being taken on line 1—1 of FIG. 2.
Figure 2:
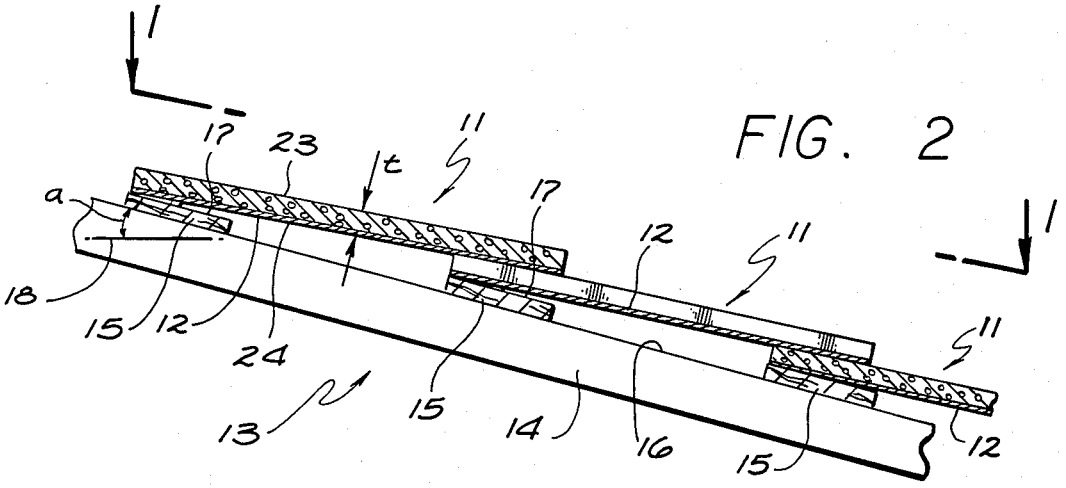
FIG. 2 is a fragmentary vertical section taken on line 2—2 of FIG. 1.

The building roof structure 10 illustrated in FIGS. 1 through 5 includes a number of identical roofing tiles 11 assembled in a series of overlapping rows R1, R2, R3, etc. and interfitting with and located by a number of water directing protective channels 12. The tiles and channels are illustrated in FIGS. 1 and 2 as attached to a conventional roof support structure 13, including the usual parallel inclined rafters 14 and a series of spaced parallel furring boards 15 nailed to the upper inclined surfaces 16 of the rafters. The inclination of rafter surfaces 16 and the parallel upper surfaces 17 of boards 15 with respect to a horizontal line represented at 18 in FIG. 2 is such as to give the overall roof structure a desired pitch angle a.

Each of the tiles 11 is desirably of rectangular configuration as viewed in FIG. 1. With reference to the central one of the tiles illustrated in that figure, each tile has parallel top and bottom end edge surfaces 19 and 20, and has two opposite side edge surfaces 21 and 22 which are parallel to one another and perpendicular to surfaces 19 and 20. Each of these edge surfaces 19, 20, 21 and 22 is desirably perpendicular to an essentially planar upper surface 23 of the tile and an essentially planar undersurface 24 of the tile parallel to surface 23. The thickness dimension t of the tile is of course relatively small as compared with the width w and length l as seen in FIG. 1.

The main body 25 of each tile is desirably molded to the discussed rectangular shape from a light weight, fire resistant, structurally very strong concrete composition. Preferably, this concrete is of essentially the composition disclosed and claimed in my copending U.S. patent application Ser. No. 6/727,794 filed Apr. 26, 1985 on "Building Material And Manufacture Thereof". To the ingredients specified in that prior application, I preferably add a quantity of small wood particles impregnated with a substance selected from the group consisting of sodium pentachlorophenol and carbon tetrachloride, to improve the heat and sound insulative characteristics of the ultimate tiles while assuring against inflammability. The details of the process disclosed in my prior application are incorporated herein by reference. With the addition of the impregnated wood particles, the preferred composition for forming the concrete tiles includes the following ingredients in about the proportions set forth below, by weight, intermixed with water in an amount rendering the composition moldable:

| | |
|---|---|
| Portland Cement | 70 to 94 parts |
| Gypsum | 10 to 30 parts |
| Sodium Hydroxide | 1 to 3 parts |
| Sodium Silicate Solution (saturated) | 150 to 275 parts |
| Particles of a metal or metals selected from the group consisting of aluminum and zinc | ¼ to 1½ parts |
| An Acidic Ingredient (preferably Sodium Thiosulfate) | 2 to 5 parts |
| Wood particles impregnated with a substance selected from the group consisting of sodium pentachlorophenol and carbon tetrachloride | up to about 50% of the total composition by weight (preferably between about 25% and 50%) |

These ingredients are all intermixed intimately together to form the moldable composition, and are then placed in an appropriate mold of the proper rectangular configuration (with reinforcing elements and other parts to be discussed later), and allowed to dry, preferably for a period of several days (say four days) to a hardened porous condition. The wood particles are preferably not over about ¼ of an inch in maximum dimension, for best results between about 1/16 and ⅛ of an inch, and may be formed of virtually any available hard or soft wood, desirably the latter, such as Pines, Spruce, Hemlock, Cedar or Fir. These particles should be impregnated under a pressure sufficient to substantially fill their pores with the impregnating substance. As an example the particles may be immersed in pentachlorophenol or carbon tetrachloride at a temperature of about 70° F. and pressure of about 15 p.s.i. for a period of 1 hour.

Figures 3, 4, 5, 6:
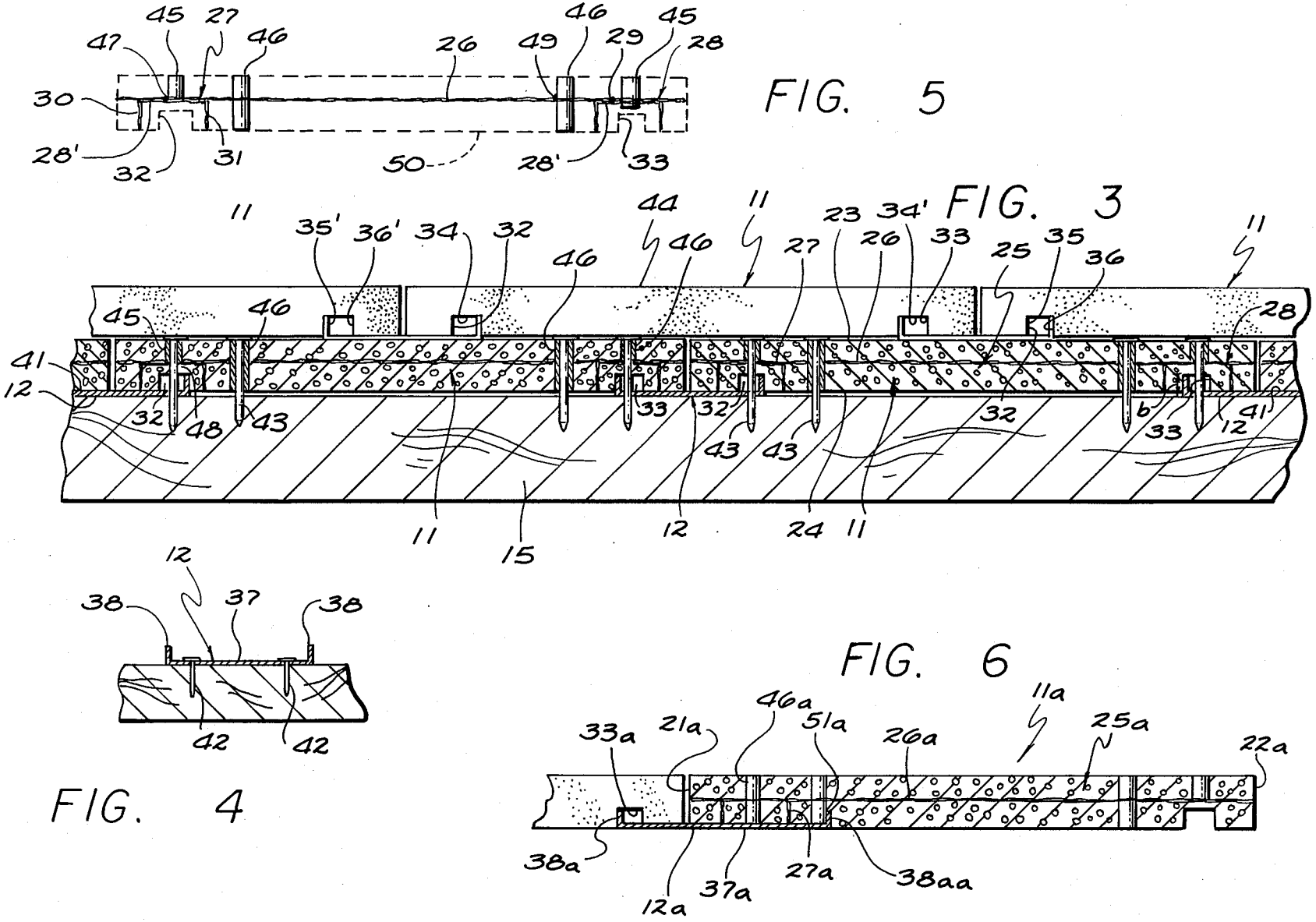
FIG. 3 is an enlarged section taken on line 3—3 of FIG. 1.
FIG. 4 is an enlarged vertical section taken on line 4—4 of FIG. 1, showing the protective channel prior to attachment of any of the tiles thereto.
FIG. 5 is a section through one of the tiles which may be considered as taken on line 5—5 of FIG. 1, and which shows in full lines the internal metal reinforcing parts and nail receiving tubes as welded together prior to molding of the concrete tile body thereabout, with the concrete body of the tile represented in broken lines.
FIG. 6 is a section taken in a plane similar to that of FIG. 5, and showing a variational form of the tile embodying the invention.

The concrete material of the body of each tile is strenghtened by a sheet 26 of reinforcing material, which may be midway between and essentially parallel to the upper and lower surfaces 23 and 24 of the tile body 25. This reinforcing sheet 26 may have the same rectangular outline configuration as body 25, to extend continuously between opposite side edges 21 and 22 and between top and bottom edges 19 and 20. Sheet 26 desirably contains a large number of apertures distributed across the entire area of the sheet, to allow the cement composition of body 25 to enter these apertures and form an effective mechanical bond with the reinforcing sheet. In the preferred arrangement, sheet 26 is formed of expanded metal, desirably expanded steel. In addition to the sheet 26, the body 25 of each tile is also strenghtened and reinforced by two identical inverted channel elements 27 and 28 extending within the tile body near and essentially parallel to its opposite side edges 21 and 22. These channel elements, like sheet 26, preferably contain a large number of apertures distributed over their entire area, and optimally are formed of the same type of expanded sheet steel utilized in forming sheet 26. As seen in FIGS. 3 and 5, each of the channel elements 27 and 28 has a top wall 28' which is parallel to and is rigidly secured to the underside of reinforcing sheet 26, desirably by tack welding the parts together as represented at 29. Projecting downwardly from opposite side edges of the top wall 28' of each channel element, that element includes two flanges 30 and 31 which are parallel to one another and parallel to the planes of opposite side edge surfaces 21 and 22 of the tile body. Top wall 28' of each channel element and its flanges 30 and 31 extend continuously along the entire length of the tile from its upper edge surface 19 to its lower edge surface 20, with the element 27 having the cross-section illustrated in FIG. 3 along that entire length between surfaces 19 and 20.

Near the two opposite side edges 21 and 22 of each tile 11, the otherwise essentially planar undersurface 24 of that tile contains two similar grooves 32 and 33. These grooves are of uniform cross-section along the entire length of the tile body between end surfaces 19 and 20, with that cross-section being as illustrated in FIG. 3. With reference to that figure, groove 32 has a top wall 34 extending parallel to top and bottom surfaces 23 and 24 of the tile body, and has two side walls 35 and 36 extending parallel to one another and parallel to side edge surfaces 21 and 22 and perpendicular to top wall 34 of the groove. Similarly, groove 33 of each tile has a top wall 34' and opposite side walls 35' and 36' corresponding to walls 34, 35 and 36 of groove 32. Each of these grooves is preferably located within and extends longitudinally of one of the channel shaped reinforcing elements 27 or 28, with the flanges 31 of that channel being received at opposite sides of the corresponding groove.

Each of the channel elements 12 is received beneath side edge portions of two adjacent tiles, at their meeting or proximate parallel side edges 21 and 22, to assist in locating the tiles during assembly of the roof, and to subsequently function for directing moisture downwardly from the top ends 19 of two of the tiles to their lower ends 20. Elements 12 may be stamped of imperforate sheet metal, preferably galvanized sheet steel of an appropriate gauge, say 26 gauge. As viewed in FIG. 1, each channel 12 is of an elongated rectangular outline shape, having a rectangular bottom wall 37 which is planar for engaging the planar undersurfaces 24 of the tiles. Extending along opposite edges of this bottom wall, each element 12 has two flanges 38 projecting upwardly perpendicular to bottom wall 37 and extending parallel to one another and parallel to edge surfaces 21 and 22 of the tiles in the assembled condition of the parts. Element 12 has a length corresponding to the length dimension l of each of the tiles, to present a first end edge 39 lying in the plane of the upper end edges 19 of the corresponding tiles, and a second edge 40 of element 12 lying in the same plane as the bottom end edges 20 of the corresponding tiles. The channel shaped cross-section of element 12 is uniform and as illustrated in FIG. 3 through the entire length of element 12 between its end edges 39 and 40. Flanges 38 are located for reception within grooves 32 and 33 of two adjacent tiles in the FIG. 3 assembled condition of the parts, and have a vertical dimension b which is slightly less than the vertical dimension of the grooves to allow the undersurfaces of the tiles to engage the bottom walls 37 of elements 12 at 41. Bottom walls 37 are thin enough to allow nails to be easily driven downwardly through those bottom walls near top edges 39 and into boards 15 as represented at 42 in FIG. 4, to thus attach each of the channels 12 to the roof support structure 14–15 prior to placement of the corresponding tiles on the channel.

The tiles are secured in place on the supporting structure and channels 12 by nails 43 (FIG. 3) driven downwardly through the tile bodies and into boards 15 of the roof support structure. In order to prevent splitting of the tiles by these nails, and to prevent damage to a paint or baked glaze surface coating 44 which is desirably applied to the upper surface 23 of each tile, there are pre-embedded within the body of each tile a number of short desirably metal tubes 45 and 46 which extend dowardly from the upper surface 23 of the tile and have their axes perpendicular to that surface and to undersurface 24, and each of which is dimensioned to receive one of the nails 43 driven through the tube and tile perpendicular to surfaces 23 and 24. These tubes preferably have an internal diameter between about ⅛ and 3/16 of an inch. In the arrangement illustrated in FIG. 1, each of the tiles has two of the tubes 45, with these tubes being located directly above the two grooves 32 or 33 respectively near the top and edge 19 of the tile. Tubes 45 are preferably tack welded at 47 to reinforcing sheet 26, and desirably terminate downwardly at that sheet to leave a thin wall 48 of the concrete material beneath sheet 26 through which a nail must be driven in order to extend downwardly from tube 45 into and through the corresponding groove 32 or 33. In addition to the two short tubes 45, each of the tiles is illustrated as having two longer tubes 46, which are also tack welded to sheet 26 at 49, and which extend through openings in that sheet and through the entire vertical thickness of the tile between its upper and lower surfaces 23 and 24. These tubes 46 may be of the same diameter as tubes 45, and are located laterally inwardly of the expanded metal reinforcing channel 47.

In manufacturing each of the tiles 11, the expanded metal reinforcing sheet 26, expanded metal channel elements 27 and 28, and tubes 45 and 46 are first welded together as a preassembly as illustrated in FIG. 5, to hold these parts in their deisred relative orientation, and to hold the tubes 45 and 46 in a proper vertically extending position as illustrated. This welded sub-assembly is then positioned within a mold, and the concrete composition is poured into the mold about the various metal elements as illustrated by the broken lines 50 of FIG. 5. The composition is allowed to dry and cured to a hardened condition about the metal elements to thus complete the tiles. The grooves 32 and 33 may be either molded into the underside of the tile, or cut into that undersurface by a routing procedure after the tile has been completed.

In assembling the tiles and protective channels 12 on a roof, these parts are of course applied in successive rows as in conventional roofing procedures, with the row R1 of FIG. 1 being applied first, then the row R2, then the row R3, etc. In attaching the initial row R1, a workman first attaches a series of the channel elements 12 to the roof support structure in properly spaced relation, by driving nails downwardly through the upper end portions of those elements 12 as illustrated in FIG. 4. The tiles 11 are then placed on these channels 12, with the opposite side edge portions of each of the tiles being supported on two of the channels 12 as illustrated, and with the flanges 38 of the channel elements projecting upwardly into grooves 32 and 33 of the tiles. The interfitting relationship of the flanges and grooves acts to locate the tiles generally in proper positions with respect to channel elements 12, while at the same time allowing substantial lateral adjustment of the tiles relative to the flanges to permit the side edges 21 and 22 of two adjacent tiles to be brought into close proximity and preferably continuous engagement with one another. To permit this lateral shifting movement of the tiles, the horizontal width of each of the grooves is substantially greater than the thickness of the corresponding flange, preferably several times the thickness of that flange. After a particular tile has been properly positioned with respect to the supporting channel elements 12 and the engaging adjacent prepositioned tile, nails are driven downwardly through tubes 45 and 46 and into boards 15 and/or rafters 14 to positively secure the tiles in place. The nails driven through tubes 45 above grooves 32 and 33 are forced through the short wall 48 of concrete and then downwardly through the corresponding grooves and through bottom wall 37 of each of the channel elements. The tile and channels are preferably so located relative to one another as to assure such extension of the nails 43 downwardly into bottom walls 37 of the channel elements and at the inner sides of flanges 38, as illustrated in FIG. 3. The nails which are driven downwardly through the longer tubes 46 do not pass through channel elements 12. It is also noted that after one of the nails has been driven into one of the tubes, the tile is then free to pivot slightly about that nail to any desired position in adjusting the tile to a proper orientation.

After the first row R1 of tiles and channel elements 12 has been attached to the roof support structure, the second row R2 can be applied in a similar manner. As seen in FIG. 1, this second row should be so positioned that the lower end portions of the tiles of row R2 and the lower end portions of the channel elements 12 of row R2 overlap or overlie the upper end portions of the tiles and channels of row R1, and in particular overlie the nails 42 and 43 which secure the tiles and channels of row R1 in place. The next successive row R3 is similarly attached to the roof support structure in overlapping relationship with respect to row R2, and subsequent rows are in similarly overlapping relation until the entire roof has been completed. Ridge and valley tiles similar to those illustrated but specially shaped can be provided at the ridges and valleys of the roof.

After the roof has been completed, the channels 12 positively prevent any leakage through the roof at the locations between successive tiles. Any rain water which falls donwardly between the engaging edges 21 and 22 of two adjacent tiles will strike the bottom wall 37 of the underlying channel element 12, and will flow downwardly along that bottom wall for discharge onto the upper surface of a tile of the next lower row. During its travel downwardly along the inclined bottom wall 37 of the channel element, the water is confined effectively between the two side flanges 38 of that element 12, to prevent any lateral escape of the water. In this way, all water is directed downwardly from the topmost portion of the roof to its bottom edge without danger of leakage through the roof.

FIG. 6 illustrates a variational arrangement in which each of the tiles 11*a* may be identical with the tiles 11 of FIGS. 1 through 5 except for the manner in which a channel element 12*a* serving the function of the channel 12 of the first form of the invention is formed and mounted. Channel 12*a* of FIG. 6 has a planar bottom wall 37*a* corresponding to bottom wall 37 of the first form of the invention, and has two upwardly projecting flanges 38*a* and 38*aa* for engaging two successive tiles. In FIG. 6, element 12*a* is not handled separately from the two tiles, but rather is permanently attached to one of the tiles, specifically the righthand tile as seen in FIG. 6. Bottom wall 12*a* of the channel may be prewelded at 51 to nail receiving tubes 45*a* and 46*a* corresponding to tubes 45 and 46 of the first form of the invention, and flange 38*aa* may project upwardly into the molded cement body 25*a* of the attached tile. Bottom wall 37*a* extends along the undersurface of that molded body of the tile by which it is carried, and projects laterally beyond side edge surface 21*a* to locate the second flange 38*a* for reception within groove 33*a* of the next successive tile. The expanded metal reinforcing sheet 26*a* and expanded metal reinforcing channels 27*a* may be identical in FIG. 6 with the corresponding elements of the first form of the invention. In forming the tile of FIG. 6, all of the metal parts are prewelded together in a manner similar to that illustrated in FIG. 5, and with the addition of the preassembled metal channel 12*a*, after which the cement material is molded in place about the metal parts and to the desired configuration.

The tiles of FIG. 6 are attached to the supporting boards 15 by driving nails downwardly through tubes 45*a* and 46*a* as in the first form of the invention. Also, the tiles of each row are positioned to overlap the upper edge portions and attaching nails of the preceding row, as in FIG. 1. The channels 12*a* of the second form of the invention function to catch any water which flows downwardly between the adjacent edges 21*a* and 22*a* of successive tiles, with that water being confined between the flanges 38*a* and 38*aa* at the sides of element 12*a*, to thus be directed downwardly at an inclination within the channel element and to its lower end as in FIGS. 1 to 5 to prevent leakage of water through the roof assembly.

While certain specific embodiments of the present invention have been disclosed as typical, the invention is of course not limited to these particular forms, but rather is applicable broadly to all such variations as fall within the scope of the appended claims.

I claim:

1. A roof comprising:

an inclined support structure;

a series of horizontal rows of essentially rectangular roofing tiles supported on said structure with the tiles in each row aligned laterally with one another and with the tiles of successive rows overlapping one another and being staggered laterally relative to one another;

the individual tiles having tile bodies which are formed of cement composition and have upper and lower surfaces and an essentially rectangular configuration defined by essentially parallel top and bottom edges and essentially parallel opposite side edges received adjacent side edges of adjacent tiles in the same row;

individual ones of said cement composition tile bodies containing two downwardly facing grooves formed in the lower surface of the tile body near and generally parallel to said side edges respectively;

apertured sheets of reinforcing material embedded within the tile bodies between said upper and lower surfaces thereof and extending across the major portion of the rectangular area thereof;

individual ones of said tiles containing two inverted channels of apertured reinforcing material embedded within the tile body beneath said sheet of reinforcing material and above said two grooves respectively and each having a top wall near said sheet and flanges projecting downwardly therefrom at opposite sides of one of said grooves;

tubes embedded in said tile bodies between said upper and lower surfaces thereof;

a plurality of protective channels beneath said tiles at the locations of said side edges and each having an inclined bottom wall extending beneath two adjacent side edges of adjacent tiles and two flanges projecting upwardly into said grooves in the two adjacent tiles;

each protective channel having a length substantially coextensive with the length of said side edges of two tile bodies engaged thereby, and terminating in end edges essentially coinciding with said top and bottom edges of said engaged tile bodies, with an upper one of said end edges of the protective channel being received entirely beneath a single tile in a next upper row of tiles; and fasteners driven downwardly through said tubes and into said support structure to secure the tiles thereto.

2. A roof as recited in claim 1, in which said top walls of said inverted channels of apertured reinforcing material are welded to said sheets of reinforcing material thereabove.

3. A roof as recited in claim 1, in which said tubes are welded to said sheets of reinforcing material.

4. A roof as recited in claim 1, in which, in individual ones of said tiles, said sheet of reinforcing material and said inverted channels of apertured reinforcing material therebeneath and said tubes are all welded rigidly together.

5. A roof comprising:

an inclined support structure, a series of horizontal rows of essentially rectangular roofing tiles supported on said structure with the tiles in each row aligned laterally with one another and with the tiles of successive rows overlapping one another and being staggered laterally relative to one another;

the individual tiles having tile bodies which are formed of cement composition and having upper and lower surfaces and an essentially rectangular configuration defined by essentially parallel top and bottom edges and essentially parallel opposite side edges received adjacent side edges of adjacent tiles in the same row;

said cement composition tile bodies containing downwardly facing grooves formed in the lower surfaces of the tile bodies generally parallel to said side edges;

apertured sheets of reinforcing material embedded within the tile bodies between said upper and lower surfaces thereof and extending across the major portion of the rectangular area thereof;

individual ones of said tiles containing two inverted channels of apertured reinforcing material embedded within the tile body beneath said sheet of reinforcing material and each having a top wall near said sheet and flanges projecting downwardly therefrom;

tubes embedded in said tile bodies and extending between said upper and lower surfaces thereof;

a plurality of protective plates beneath said tiles at the locations of said side edges and each having an inclined bottom wall secured to one tile body and projecting therefrom beneath a side edge of that body and an adjacent side edge of an adjacent tile body, and having a flange projecting upwardly into one of said grooves in said adjacent tile body;

each protective plate having a length substantially coextensive with the length of said side edges of two tile bodies engaged thereby, and terminating in end edges essentially coninciding with said top and bottom edges of said engaged tile bodies with an upper one of said end edges of the protective plate being received entirely beneath a single tile in a next upper row of tiles; and fasteners driven downwardly through said tubes and into said support structure to secure the tiles thereto.

6. A roof as recited in claim 5, in which said top walls of said inverted channels of apertured reinforcing material are welded to said sheets of reinforcing material.

7. A roof as recited in claim 5, in which said tubes are welded to said sheets of reinforcing material.

8. A roof as recited in claim 5, in which said top walls of said inverted channels of apertured reinforcing material and said tubes and said sheets of reinforcing material are welded rigidly together.

9. A roof comprising:

an inclined support structure;

a series of horizontal rows of essentially rectangular roofing tiles supported on said structure with the tiles in each row aligned laterally with one another and with the tiles of successive rows overlapping one another;

the individual tiles having tile bodies which are formed of cement composition and have upper and lower surfaces and an essentially rectangular configuration defined by essentially parallel top and bottom edges and essentially parallel opposite side edges received adjacent side edges of adjacent tiles in the same row;

said cement composition tile bodies containing downwardly facing grooves formed in the lower surfaces of the tile bodies generally parallel to said side edges;

apertured sheets of reinforcing material embedded within the tile bodies between said upper and lower surfaces thereof and extending across the major portion of the rectangular area thereof;

said tiles containing inverted channels of apertured reinforcing material embedded within the tile body beneath said sheets of reinforcing material and each having a top wall near one of said sheets and flanges projecting downwardly therefrom;

tubes embedded in said tile bodies between said upper and lower surfaces thereof;

a plurality of protective plates beneath said tiles at the locations of said side edges and each having an inclined bottom wall extending between two adjacent side edges of adjacent tiles to intercept rain falling therebetween and having a flange projecting upwardly into one of said grooves in a tile body;

each protective plate having a length substantially coextensive with the length of said side edges of two tile bodies engaged thereby, and terminating in end edges essentially coinciding with said top and bottom edges of said engaged tile bodies, with an upper one of said end edges of said protective plate being received entirely beneath a single tile in a next upper row of tiles; and fasteners driven downwardly through said tubes and into said support structure to secure the tiles thereto.

10. A roof as recited in claim 9, in which said sheets of reinforcing material and said top walls of said inverted channels of apertured reinforcing material are secured directly and rigidly together.

11. A roof as recited in claim 9, in which said tubes are secured directly and rigidly to said sheets of reinforcing material.

12. A roof as recited in claim 9, in which said top walls of said inverted channels of apertured reinforcing material and said tubes and said sheets of reinforcing material are welded together.

13. A roof comprising:

an inclined support structure;

a series of horizontal rows of essentially rectangular roofing tiles supported on said structure with the tiles in each row aligned laterally with one another and with the tiles of successive rows overlapping one another and being staggered laterally relative to one another;

the individual tiles having tile bodies which are formed of cement composition and have upper and lower surfaces and an essentially rectangular configuration defined by essentially parallel top and bottom edges and essentially parallel opposite side edges received adjacent side edges of adjacent tiles in the same row;

said cement composition tile bodies containing downwardly facing grooves formed in the lower surfaces of the tile bodies generally parallel to said side edges;

a plurality of protective plates beneath said tiles at the locations of said side edges and each having an inclined bottom wall extending beneath two adjacent side edges of adjacent tiles to intercept rain falling therebetween and direct the rain toward said bottom edges of the tiles;

said bottom wall of each protective plate extending between two adjacent tiles and having a flange projecting upwardly into one of said grooves in the underside of one of the tiles;

each protective plate having a length substantially coextensive with the length of said side edges of two tile bodies engaged thereby, and terminating in end edges essentially coinciding with said top and bottom edges of said engaged tile bodies with an upper one of said end edges of the protective plate being received entirely beneath a single tile in a next upper row of tiles.

14. A roof as recited in claim 13, in which individual ones of said protective plates have a portion embedded in one of said tiles near a side edge thereof, and have said bottom wall and flange projecting therebeyond for engagement with an adjacent tile.

15. A roof as recited in claim 13, in which each of said tiles has two of said grooves formed in its undersurface near said two side edges respectively thereof, and each of said protective plates has two of said flanges adapted to project upwardly into two of said grooves in adjacent tiles.

16. A roof comprising:

an inclined support structure;

a series of horizontal rows of essentially rectangular roofing tiles supported on said structure with the tiles in each row aligned laterally with one another and with the tiles of successive rows overlapping one another;

the individual tiles having tile bodies which are formed of cement composition and have upper and lower surfaces and an essentially rectangular configuration defined by essentially parallel top and bottom edges and essentially parallel opposite side edges received adjacent side edges of adjacent tiles in the same row;

said cement composition tile bodies containing downwardly facing grooves formed in the lower surfaces of the tile bodies generally parallel to said side edges;

apertured sheets of reinforcing material embedded within the tile bodies between said upper and lower surfaces thereof and extending across the major portion of the rectangular area thereof;

said tiles containing inverted channels of apertured reinforcing material embedded within the tile bodies beneath said sheets of reinforcing material and having a top wall near one of said sheets and flanges projecting downwardly therefrom at opposite sides of one of said grooves; and a plurality of protective plates beneath said tiles at the locations of said side edges and each having an inclined bottom wall extending beneath two adjacent side edges of adjacent tiles and a flange projecting upwardly into one of said grooves in one of two adjacent tiles.

17. A roof as recited in claim 16, in which said sheet of reinforcing material within a particular tile is secured directly and rigidly to said top wall of one of said inverted channels of apertured reinforcing material within that tile.

18. A roof as recited in claim 16, including tubes embedded within said tile bodies, and fasteners driven downwardly through said tubes into said support structure to secure the tiles thereto.

19. A roof as recited in claim 16, including tubes embedded within said tile bodies above said inverted channels of apertured reinforcing material, and fasteners driven downwardly through said tubes and through said inverted channels and said grooves and into said support structure to secure said tiles thereto.

20. A roof as recited in claim 16, including tubes embedded within said tile bodies above said inverted channels of apertured reinforcing material, and fasteners driven downwardly through said tubes and through said inverted channels and said grooves and through said bottom walls of said protective plates into said support structure to secure said tiles thereto.

* * * * *